US009653839B2

(12) United States Patent
Andresen et al.

(10) Patent No.: US 9,653,839 B2
(45) Date of Patent: May 16, 2017

(54) INDUSTRIAL ELECTRICAL PLUG CONNECTOR

(71) Applicant: PHOENIX CONTACT GMBH & CO. KG, Blomberg (DE)

(72) Inventors: Jens Andresen, Blomberg (DE); Thorsten Diessel, Hiddenhausen (DE); Dennis Sprenger, Horn-Bad Meinberg (DE); Detlef Nehm, Schieder-Schwalenberg (DE)

(73) Assignee: PHOENIX CONTACT GMBH & CO. KG, Blomberg (DE)

( * ) Notice: Subject to any disclaimer, the term of this patent is extended or adjusted under 35 U.S.C. 154(b) by 0 days.

(21) Appl. No.: 14/770,092

(22) PCT Filed: Feb. 27, 2014

(86) PCT No.: PCT/EP2014/053848

§ 371 (c)(1),
(2) Date: Aug. 25, 2015

(87) PCT Pub. No.: WO2014/131839

PCT Pub. Date: Sep. 4, 2014

(65) Prior Publication Data

US 2016/0006162 A1 Jan. 7, 2016

(30) Foreign Application Priority Data

Feb. 28, 2013 (DE) ..... 10 2013 003 306

(51) Int. Cl.

| | |
|---|---|
| ***H01R 13/52*** | (2006.01) |
| ***H01R 13/58*** | (2006.01) |
| *H01R 13/502* | (2006.01) |

(52) U.S. Cl.
CPC ..... *H01R 13/5208* (2013.01); *H01R 13/5841* (2013.01); *H01R 13/502* (2013.01)

(58) Field of Classification Search
CPC ..... H01R 13/5205; H01R 13/5208; H01R 13/5202; H01R 13/5841; H01R 13/502
(Continued)

(56) References Cited

U.S. PATENT DOCUMENTS

| | | | |
|---|---|---|---|
| 4,629,276 | A | 12/1986 | Genaro et al. |
| 5,411,415 | A | 5/1995 | Embo et al. |

(Continued)

FOREIGN PATENT DOCUMENTS

| | | | |
|---|---|---|---|
| DE | 19718392 | A1 | 11/1998 |
| DE | 19952643 | C1 | 3/2001 |

(Continued)

OTHER PUBLICATIONS

Japanese Office Action, Japanese Patent Office, Jul. 4, 2016, pp. 1-4.

*Primary Examiner* — Khiem Nguyen
(74) *Attorney, Agent, or Firm* — Leydig, Voit & Mayer, Ltd

(57) ABSTRACT

A connector includes a housing, in which at least one contact is arranged. The housing includes at least one contact element, a base, a holder, and at least one lateral surface having an opening for passing a cable through and a holder for attaching a cable gland to the housing. The at least one lateral surface is inclined at an angle (α) of between 30° and 50° relative to the base. The connector also includes at least one cable gland, the cable gland including a support surface inclined relative to a longitudinal direction of the cable gland at an angle (β) of between 40° and 60°.

12 Claims, 9 Drawing Sheets

(58) Field of Classification Search
USPC ..... 439/449, 450, 275
See application file for complete search history.

(56) References Cited

U.S. PATENT DOCUMENTS

| | | | | |
|---|---|---|---|---|
| 6,338,645 | B1 | 1/2002 | Tan et al. | |
| 6,942,508 | B2 | 9/2005 | Wong | |
| 7,168,969 | B1 | 1/2007 | Wang | |
| 7,273,384 | B1 * | 9/2007 | So | H01R 13/447 439/172 |
| 9,054,472 | B2 * | 6/2015 | Chen | H01R 24/66 |
| 2005/0074996 | A1 | 4/2005 | Wong | |

FOREIGN PATENT DOCUMENTS

| | | | |
|---|---|---|---|
| DE | 10119910 | C1 | 8/2002 |
| DE | 20308570 | U1 | 10/2004 |
| DE | 69928657 | T2 | 8/2006 |
| EP | 0059566 | A1 | 9/1982 |
| EP | 1437804 | A2 | 7/2004 |
| JP | 60071083 | U | 5/1985 |
| JP | S 62115680 | A | 5/1987 |
| JP | H 07500219 | A | 1/1995 |
| JP | 2009187955 | A | 8/2009 |

* cited by examiner

INDUSTRIAL ELECTRICAL PLUG CONNECTOR

CROSS REFERENCE TO RELATED APPLICATIONS

This application is a U.S. National Phase application under 35 U.S.C. §371 of International Application No. PCT/EP2014/053848, filed on Feb. 27, 2014, and claims benefit to German Patent Application No. DE 10 2013 003 306.3, filed Feb. 28, 2013. The international application was published in German on Sep. 4, 2014, as WO 2014/131839 A1 under PCT Article 21(2).

FIELD

The invention relates to connectors, and more particularly, to heavy duty industrial connectors.

BACKGROUND

Connectors, in particular heavy duty industrial connectors, are designed especially for use in particularly harsh environments. Such industrial connectors normally comprise a housing having a base part and a plug-in part, the plug-in part being connectable to the base part. Inside the housing at least one contact element is arranged, which can be formed of two or more contact inserts, at least one contact insert being arranged in the base part and at least one contact insert being arranged in the plug-in part respectively and when the base part is connected to the plug-in part, the corresponding contact inserts can be electrically connected to one another. It is normally provided for the housing to be formed of a metal, for example in the form of a the cast metal part, the housing being able to offer reliable protection for the contact inserts against environmental influences. Industrial connectors are used, for example, in the automotive industry, in machinery and plant engineering, in conveyor systems as well as in measurement and control technology and, depending on the application, can have contact inserts with, for example, 6 to 108-pin construction.

The contact inserts and the contact element are connected to at least one cable, it being possible to insert the cable into the housing through a cable gland. The cable can also be formed as a flexible hose, for example in the form of a compressed air hose when pneumatic modules are used as the contact inserts. In the process, the cable can only ever be mounted on the housing at a specific angle. It can therefore happen in particular in confined installation conditions that the electrical cable is buckled when inserted into the connector and therefore damaged such that it has to be replaced by another cable.

SUMMARY

In an embodiment, the present invention provides a connector including a housing, in which at least one contact is arranged, and at least one cable gland. The cable gland is configured to be attached to the housing and is configured to have a cable passed through, the cable capable of being contacted to at least one contact element in the housing. An opening for passing the cable through and a holder for attaching the cable gland to the housing are formed on at least one lateral surface of the housing. The cable gland can be attached to the holder in a first position with a first cable outlet direction and in a second position with a second cable outlet direction, wherein the at least one lateral surface of the housing is inclined at an angle ($\alpha$) of between 30° and 50° relative to a base of the housing. The cable gland has a support surface configured to support the cable gland on the lateral surface of the housing in an attached state. The support surface of the cable gland is inclined relative to a longitudinal direction of the cable gland at an angle ($\beta$) of between 40° and 60°.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
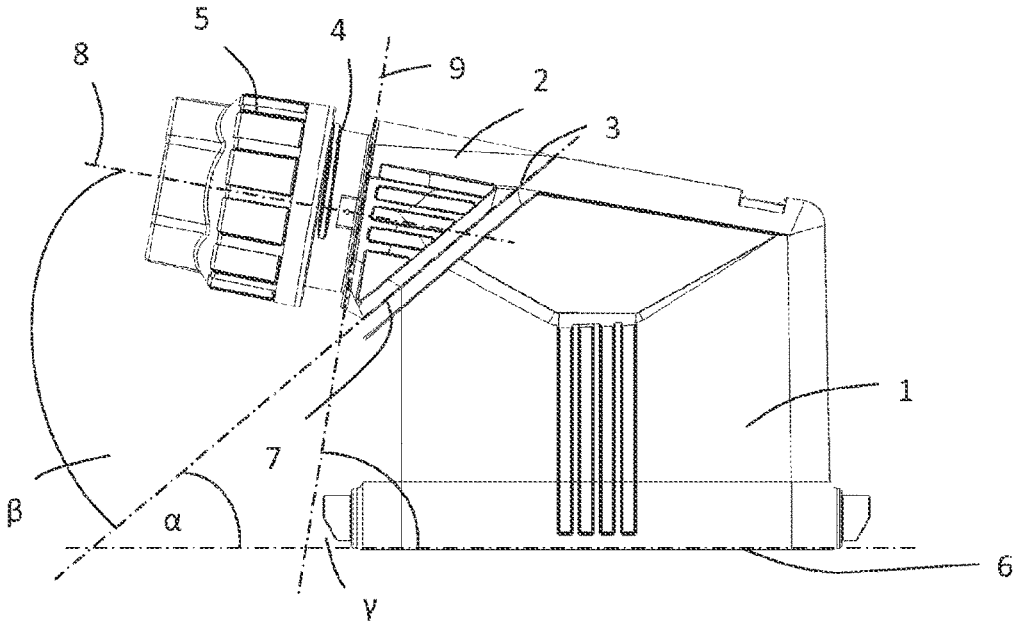
FIG. 1 is a schematic view of a connector according to an embodiment of the invention with a housing and a cable gland, the cable gland being arranged in a first position relative to the housing.

An embodiment of the invention provides a connector where damage to the cable during connection of the cable to the connector can be prevented.

In an embodiment of the invention, the connector has a housing in which at least one contact element is arranged, and at least one cable gland, which can be attached to the housing, for passing a cable through, which can be contacted to the at least one contact element in the housing, an opening for passing the cable through and a holder for attaching the cable gland to the housing being formed on at least one lateral surface of the housing, it being possible to attach the cable gland to the holder in a first position with a first cable outlet direction and in at least one second position with a second cable outlet direction, the lateral surface, having the holder for the cable gland, of the housing being inclined at an angle of between 30° and 50° relative to a base of the housing, the cable gland having a support surface to support it on the lateral surface, having the holder, of the housing in an attached state, the support surface being inclined at an angle of between 40° and 60° relative to a longitudinal direction of the cable gland.

A connector according to an embodiment of the invention is characterised in that one or more cable glands can be attached to the housing, which can be formed integrally, not just in one position but rather in at least two positions, each position of the cable gland on the housing allowing a different passage of the cable or of a cable formed as a hose out of the housing or into the housing respectively, without having to provide the housing with a second connection for a further cable gland. Both the housing and the cable gland, which can be formed integrally, have a particular geometric configuration to provide a variety of positions, in that the lateral surface of the housing, which has a holder for the cable gland and can be formed on a front lateral surface of the housing, is inclined at an angle of between 30° and 50° relative to a base of the housing and the support surface of the cable gland is inclined at an angle of between 40° and 60° relative to the longitudinal direction of the cable gland. The angle between the longitudinal direction of the cable gland and the support surface of the cable gland can be greater than the angle between the base and the lateral surface of the housing, which lateral surface has the holder and to which the cable gland can be attached. The cable gland can be placed onto the lateral surface of the housing in at least two different positions, as a result of which the cable outlet direction of the cable passed through the cable gland can be varied. Therefore a differently formed cable gland no longer has to be used for each cable outlet direction, but rather this can now be achieved by means of a single cable gland, i.e. with the same cable gland. Furthermore, the connector is characterised by a high variability since only one housing is now needed in comparison with conventional connectors, to which various cable glands, which can each receive a certain size of cables, can be attached. The otherwise necessary diversity of variations of connectors, and in particular of housings of the connectors, can be reduced substantially as a result.

In an embodiment of the invention, the cable gland is attached to the housing using a connection, which can, for example, be joined simply by hand but can only be released again by means of a tool. It is, however, also possible for the connection to only be achievable, for example lockable, by means of a tool. As a result of this, a high degree of connection reliability can be ensured. The connection can be formed on an outer lateral surface of the housing and an outer lateral surface of the cable gland. Furthermore, the connection can also be formed by means of the lateral surface of the housing having the opening for passing the cable through and by means of the support surface of the cable gland so that the connection is formed between the housing and the cable gland.

In order to form the attachment, the cable gland can be attached to the housing by means of a bayonet-type locking mechanism. The bayonet-type locking mechanism allows a rapidly executable rotary attachment since to connect the cable gland, which is positioned on the housing, a rotary movement of the cable gland relative to the housing by only roughly 45° is necessary. The bayonet-type locking mechanism can be formed such that it is manually lockable, but can only be released again with the aid of a tool.

Furthermore, it can be provided for an annular surface formed on the cable gland to engage in the opening in the housing in an attached state of the cable gland to the housing, the holder of the housing having at least two web elements arranged in the opening in the housing to form the bayonet-type locking mechanism and at least two undercuts, into which the web elements can be inserted and locked, being formed on an outer circumferential surface of the annular surface of the cable gland. The annular surface engaging in the opening in the housing allows the greatest possible tilt-free mounting of the cable gland on the housing even before the bayonet-type locking mechanism has been locked and so that the cable gland is attached to the housing such that it cannot fall out. The web elements and the undercuts together form the bayonet-type locking mechanism in that one web element is inserted along each undercut and locked inside the undercut. The length of the web elements and the length of the undercuts are such that the locking of the web elements with the undercuts is possible by a one-eighth rotation of the cable gland, i.e. a rotation of roughly 45° about the axis of rotation of the cable gland. As a result of this, a rapid and secure assembly of the cable gland to the housing is facilitated. By increasing the number of web elements, e.g. by providing more than two web elements, the necessary angle at which the cable gland is screwed when screwing it onto the housing can be reduced.

In an embodiment of the invention, four web elements can be arranged in the opening in the housing, it being possible for two respective web elements to be arranged diagonally to one another in each case, one first pair of diagonally arranged web elements being longer than a second pair of diagonally arranged web elements. As a result of this, a kind of key can be formed, by means of which incorrect positioning of the cable gland on the housing can be prevented and thus a correct positioning of the cable gland on the housing can be ensured. It is, however, also possible for the holder of the housing to only have two web elements, which are arranged at the opening in the housing, it being possible for these two web elements to be arranged opposite one another or arranged on the same side, at a distance from one another.

A particularly secure attachment of the cable gland to the housing can be achieved by providing a holder of the housing that has at least two locking cams arranged on the lateral surface of the housing in order to form the bayonet-type locking mechanism and/or the cable gland has at least two locking cams arranged on the support surface of the cable gland, which in the attached state can engage in recesses arranged in the lateral surface of the housing and/or on the support surface of the cable gland. For example, two locking cams and two recesses can be provided, which can each be arranged in a corner region of the lateral surface of the housing and in a corner region of the support surface of the cable gland. In the case of two locking cams and two recesses, the two locking cams can be arranged opposite one another or diagonally opposite one another and the two recesses are likewise arranged opposite one another or diagonally opposite one another. In order to be able to make the attachment of the cable gland to the housing particularly robust, four locking cams and four recesses can be provided, which each can be arranged in a respective corner region of a rectangular lateral surface of the housing and a rectangular support surface of the cable gland.

In order to achieve a reduction of the necessary assembly forces when attaching the cable gland to the housing, the locking cams can have a different height. This is can be advantageous if four locking cams are provided, two locking cams arranged opposite one another, i.e. diagonally opposite one another, can then each have the same height and the locking cams arranged next to one another can have different heights.

Furthermore, the locking cams can have a sliding surface formed with an incline, the sliding surface being curved. A sliding surface constitutes a respective upper side or surface of a locking cam, with which the element in which the recesses are arranged, i.e. the lateral surface of the housing which has the holder or the support surface of the cable gland, mainly comes into contact during an execution of the attachment of the cable gland to the housing as well as during a release of the attachment. The support surface of the cable gland or the lateral surface of the housing can thus slide onto the sliding surface of the locking cam when executing the attachment and also when releasing the attachment. As a result of the sliding, it can be ensured that the cable connection also abuts the housing during the movement along the locking cams as a result of a rotary movement of the cable connection relative to the housing. As a result of this, a kind of guide during the attaching procedure and during the release procedure of the attachment can be provided such that incorrect assembly can be prevented. Moreover, as a result of this a warping of the material of the cable glands and also a deformation on the locking cams caused by the large forces acting in the process can be prevented when forming the attachment and when releasing the attachment. Because the sliding surface of the locking cam has an incline, a sliding of the lateral surface of the housing or of the support surface of the cable gland onto the sliding surface and thus onto the locking cam can be made easier whilst simultaneously protecting the material, in particular the material of the cable gland. The sliding surface extends in a curved manner, in particular curved in the direction of rotation of the cable gland to attach the cable gland to the housing, curved meaning that the sliding surface is adapted to the circular shape of the opening and the circular shape of the annular surface. As a result of this, an abutment of the lateral surface of the housing or of the support surface of the cable gland, depending on where the recesses and the locking cams are formed, on the sliding surface of the locking cams can be ensured even during a rotary movement of the cable gland relative to the housing.

Furthermore, it is possible for the sliding surface to be formed such that during transfer into the attached state, the sliding surface has a notching effect. The notching effect has the effect that the respective locking cam cuts into the material of the element in which the recesses are formed, i.e. on the support surface of the cable gland or on the lateral surface of the housing having the holder, during a rotary movement of the cable gland to attach the cable gland to the housing and as a result of this, the locking cam interlocks with the respective element into which it is has cut. As a result of the notching effect, tensions in the corresponding elements, in particular on the support surface of the cable gland and/or on the lateral surface of the housing, can be reduced and moreover, a particularly secure attachment of the cable gland to the housing can be ensured.

In order to simplify the guiding and positioning of a cable inside the cable gland, the annular surface can have at least one flattened region for accommodating the cable.

To seal the transition between the cable gland and the housing in an attached state, the housing and/or the cable gland can have a sealing element. The sealing element can be held particularly securely by means of a retainer formed on the housing and/or on the cable gland, as a result of which an unintentional slipping of the sealing element from the housing or from the cable gland can be prevented. The retainer can be formed by a projecting edge portion, behind which the sealing element can be clamped. The sealing element can, for example, be formed as an O-ring.

Furthermore, the diameter of the opening in the housing can be roughly equivalent to the width of the housing. As a result of this, the space for the cables and the cabling inside the housing can be enlarged in comparison with conventional embodiments in which the diameter of the opening is normally substantially smaller than the width of the housing. The connection of the cables inside the housing can also be simplified as a result. In the process, the diameter of the opening can be equivalent to the inner diameter of the opening and in the process the width of the housing can be equivalent to the width of the housing measured at the inner wall surfaces.

The housing and/or the cable gland can be formed of a plastics material. When formed of a plastics material, the housing and/or the cable gland can be produced in an injection moulding process, in which case, in particular with the housing, the opening for connecting the cable gland, which opening can be always formed to be the same size, can already be formed in the injection mould, there thus being no need for subsequent machining to form the opening.

In order to achieve a high degree of stability of the housing, the housing can be formed of a reinforced plastics material. For example, the reinforced plastics material can be a glass fibre-reinforced plastics material, for example a glass fibre reinforced polyamide.

The cable gland on the other hand can be formed of a more malleable plastics material than the housing. The cable gland can preferably be formed of a flexible plastics material, as a result of which, for example, a screw connection of the cable gland, to which a clamping nut can be attached, can have a greater flexibility.

Furthermore, it is also possible for the housing and/or the cable gland to be formed of a metal, such as aluminium or zinc. The metal housing and/or the metal cable gland can be produced by means of a metal casting process, for example a pressure die casting process or a vacuum casting process.

If the cable gland is formed of a metal, an annular plastics clamping cage and an annular plastics sealing element can be arranged in an inner space in the cable gland, and the cable guided through the cable gland can then rest against this cage and this element in a clamped manner. The sealing element can rest directly on the cable and the clamping cage which surrounds the sealing element presses the sealing element against the cable in order to attain a particularly good sealing action. By means of the clamping cage and the sealing element, a defined degree of flexibility can also be created in the region of the cable clamp. The clamping cage can be inserted into the inner space in the cable gland as a separate component and thus in a detachable manner. The clamping cage can, however, also be injected directly into the inner space in the cable gland so as to be able to form a permanent connection to a wall delimiting the inner space in the cable gland.

If the housing is formed of a metal, the lateral surface of the housing having the opening for passing the cable through and also the holder for attaching the cable gland to the housing can preferably be formed of a plastics material or coated with a plastics material. If the cable gland is formed of a metal, the support surface and/or the annular surface having the elements of the cable gland arranged thereon, e.g. the thread, can preferably be formed of a plastics material or coated with a plastics material. The plastics material can, for example, be polyamide, in particular partially aromatic polyamide, which is distinguished by high flexibility and good heat resistance.

Figure 2:
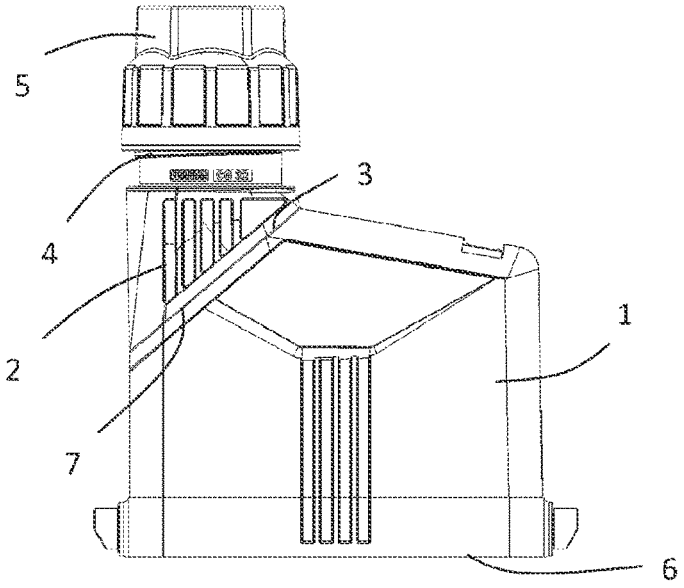
FIG. 2 is a schematic view of the connector according to an embodiment of the invention with a housing and a cable gland, the cable gland being arranged in a second position relative to the housing.

FIGS. 1 and 2 show a connector having a single-piece housing 1 and a single-piece cable gland 2, which can be attached to the housing 1 and by means of which a cable, not shown here, can be inserted into the interior of the housing 1 and electrically connected there to one or more contacts, not shown here, arranged in the interior of the housing 1. One first end of the cable gland 2 can be attached to a lateral surface 3 of the housing 1 in a detachable manner. At a second end, which is opposite the first end, the cable gland 2 has an outer thread 4 onto which a clamping nut 5 for attaching a cable passed through the cable gland 2 can be screwed.

The lateral surface 3 of the housing 1, to which the first end of the cable gland 2 can be attached, is inclined at an angle $\alpha$ of between 30° and 50°, preferably at an angle $\alpha$ of 40°, relative to a base 6 of the housing 1, which can, for example, be a straight underside of the housing 1.

The cable gland 2 has a support surface 7 on its first end, which abuts the lateral surface 3 of the housing 1 in the attached state, as shown in FIGS. 1 and 2, and is attached thereto. The support surface 7 is inclined relative to the longitudinal direction 8 of the cable gland 2 at an angle $\beta$ of between 40° and 60°, preferably at an angle $\beta$ of 50°.

The two angles $\alpha$ and $\beta$ result in an angle of projection $\gamma$, which determines the cable outlet direction of the cable and spans the base 6 of the housing 1 and a cross-sectional area 9 of the cable gland 2 arranged at an angle of 90° relative to the longitudinal direction, that is between 0° and <90°.

In the case of the embodiment shown in FIG. 1, the cable gland 2 is attached to the housing 1 in a first position with a first cable outlet direction. In the case of this first cable outlet direction, the angle of projection $\gamma$ is roughly 80°.

In the case of the embodiment shown in FIG. 2, the cable gland 2 is attached to the housing 1 in a second position with a second cable outlet direction. In the case of this second cable outlet direction, the angle of projection $\gamma$ is roughly 0°.

The same cable gland 2 can therefore be arranged in various positions to form various cable outlet directions at the housing 1.

Figure 3:
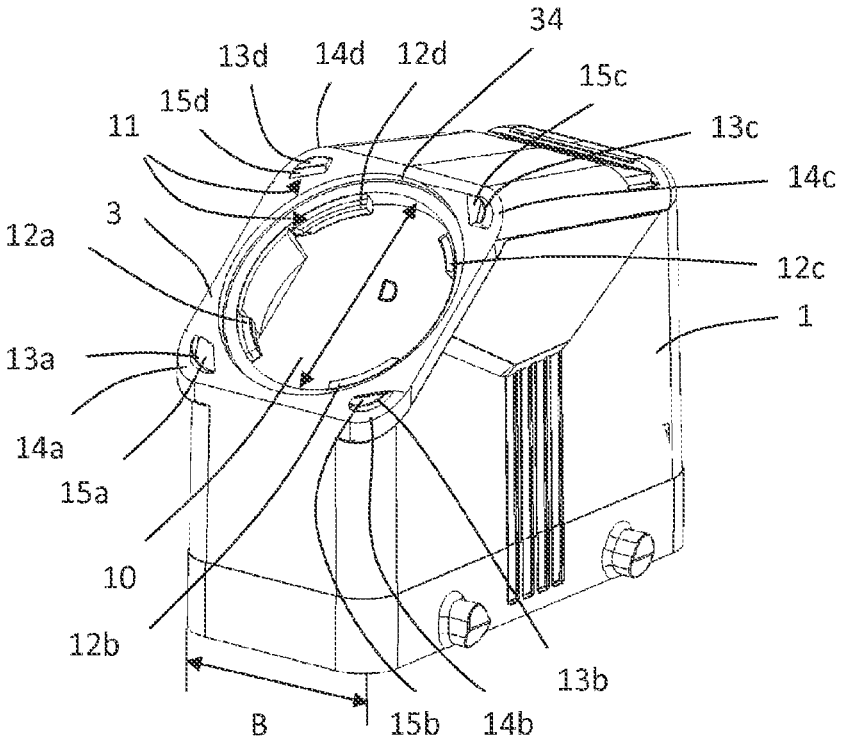
FIG. 3 is a schematic view of a housing of a connector according to an embodiment of the invention.

In FIG. 3, the housing 1 of the connector is shown in a plan view onto the lateral surface 3 of the housing 1, to which lateral surface the cable gland 2 can be attached.

The lateral surface 3 of the housing 1 has an opening 10 for passing one or more cables through. The diameter D of the opening 10 is roughly equivalent to the width B of the housing 1.

Furthermore, a holder 11 for attaching the cable gland 2 to the housing 1 is arranged on the lateral surface 3 of the housing 1. In the case of the embodiments shown in FIG. 3-7, the cable gland 2 can be attached to the housing 1 by means of a bayonet-type locking mechanism.

For the bayonet-type locking mechanism, the holder 11 has web elements 12*a*, 12*b*, 12*c*, 12*d* arranged at or in the opening 10 in the housing 1. In the embodiment shown here, four web elements 12*a*, 12*b*, 12*c*, 12*d* are provided and are curved corresponding to the radius of the opening 10. Two of the web elements 12*a*, 12*b*, 12*c*, 12*d* are arranged in each case opposite, i.e. diagonally opposite, one another. The web elements 12*a*, 12*b*, 12*c*, 12*d* have different lengths, the respective opposite web elements 12*a*, 12*b*, 12*c*, 12*d* being the same length. In the case of the embodiment shown in FIG. 3, the web elements 12*a* and 12*c* have a shorter length than the web elements 12*b* and 12*d*.

Furthermore, the holder 11 has a plurality of locking cams 13*a*, 13*b*, 13*c*, 13*d*, which are arranged at a distance from the opening 10 in the lateral surface 3 of the housing 1. The locking cams 13*a*, 13*b*, 13*c*, 13*d* protrude from the surface of the lateral surface 3 such that they can interact with the support surface 7 of the cable gland 2. In the case of the embodiment shown here, four locking cams 13*a*, 13*b*, 13*c*, 13*d* are provided and each are arranged in a respective corner region 14*a*, 14*b*, 14*c*, 14*d* of the lateral surface 3 of the housing 1. The locking cams 13*a*, 13*b*, 13*c*, 13*d* can have a different height at which they protrude from the surface of the lateral surface 3 of the housing 1, the respective locking cams 13*a*, 13*b*, 13*c*, 13*d* arranged opposite one another preferably being the same height.

In order to facilitate a sliding of the support surface 7 of the cable gland 2 onto the locking cams 13*a*, 13*b*, 13*c*, 13*d*, the locking cams 13*a*, 13*b*, 13*c*, 13*d* each have a sliding surface 15*a*, 15*b*, 15*c*, 15*d* formed with an incline, which is curved. The curve of the sliding surface 15*a*, 15*b*, 15*c*, 15*d* is adapted to the curve of the opening 10, such that the sliding surface 15*a*, 15*b*, 15*c*, 15*d* is adapted to a rotary movement of the cable gland 2 relative to the housing 1.

Figure 4:
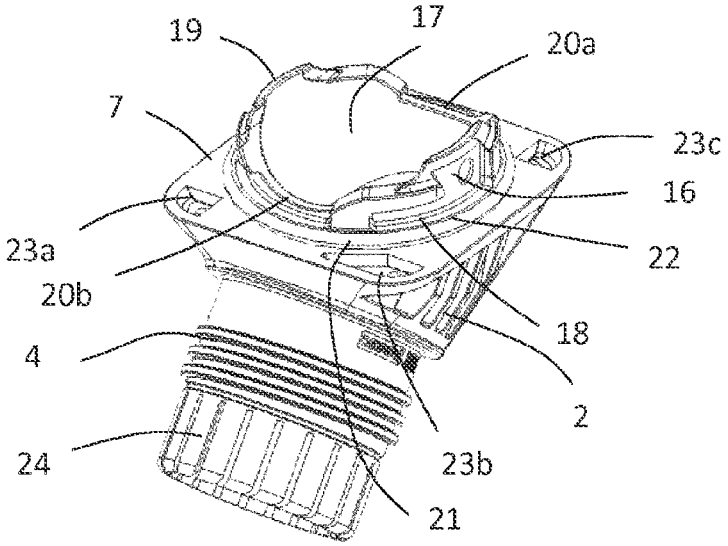
FIG. 4 is a schematic view of a cable gland of the connector according to an embodiment of the invention.

In FIG. 4, a cable gland 2 of the connector according to an embodiment of the invention is shown. The cable gland 2 has an annular surface 16 on its support surface 7, which protrudes from the support surface 7. The annular surface 16 borders an opening 17 in the cable glands 2, by means of which one or more cables can be inserted through the cable gland 2 into the housing 1. The annular surface 16 has a diameter, which is slightly smaller than the diameter D of the opening 10 in the housing 1, so that the annular surface 16 can dip into the opening 10 in the housing 1 when positioning the cable gland 2 on the housing 1.

On the outer circumferential surface of the annular surface 16, a plurality of undercuts 18 are formed, in each of which a web element 12*a*, 12*b*, 12*c*, 12*d* that is arranged on the housing 1 can interlock as a result of a rotary movement of the cable gland 2 relative to the housing 1 in order to form a bayonet-type locking mechanism. The number of undercuts 18 is adapted to the number of web elements 12*a*, 12*b*, 12*c*, 12*d* such that in the case of the embodiment shown here, four undercuts 18 are provided due to the four web elements 12*a*, 12*b*, 12*c*, 12*d*.

The free end 19 of the annular surface 16, which end forms a terminating edge of the annular surface 16, has an uneven surface such that the whole annular surface 16 has a different height across its circumference starting from the support surface 7. In particular, the annular surface 16 has two flattened regions 20*a*, 20*b* at its ends 19, where the height of the annular surface 16 is reduced in comparison with the rest of the annular surface 16.

Furthermore, on the outer circumferential surface of the annular surface 16, a sealing element 21 formed as an O-ring is arranged, which has an axial sealing action and prevents dust and moisture in particular from being able to penetrate the connection between the cable gland 2 and the housing 1. In the assembled state of the cable gland 2 on the housing 1, the sealing element 21 abuts an outer circumferential surface 34 of the opening 10 in the transition to the surface of the lateral surface 3 of the housing 1, which is marked in FIG. 3. The sealing element 21 is held by a retainer 22 on the outer circumferential surface of the annular surface 16 below the undercuts 18 such that it cannot fall off. The retainer 22 is formed in the form of an edge portion which protrudes from the outer circumferential surface of the annular surface 16 and can extend along the whole extent of the annular surface 16 or in portions along the extent of the annular surface 16.

Furthermore, a plurality of recesses 23*a*, 23*b*, 23*c* are formed in the support surface 7 and which interact with the locking cams 13*a*, 13*b*, 13*c*, 13*d* of the housing 1. The number of recesses 23*a*, 23*b*, 23*c* corresponds to the number of locking cams 13*a*, 13*b*, 13*c*, 13*d*, only three recesses 23*a*, 23*b*, 23*c* being visible in FIG. 4, however, due to the drawing, although four recesses 23*a*, 23*b*, 23*c*, 23*d* are shown.

On the second end of the cable gland 2, opposite the support surface 7, the outer thread 4 for attaching the clamping nut 5 and a large number of fins 24 are arranged in an annular manner on the cable gland 2, which fins can be pressed by means of the clamping nut 5 in a sealing manner onto a jacket of a cable inserted into the cable gland 2.

Figure 5:
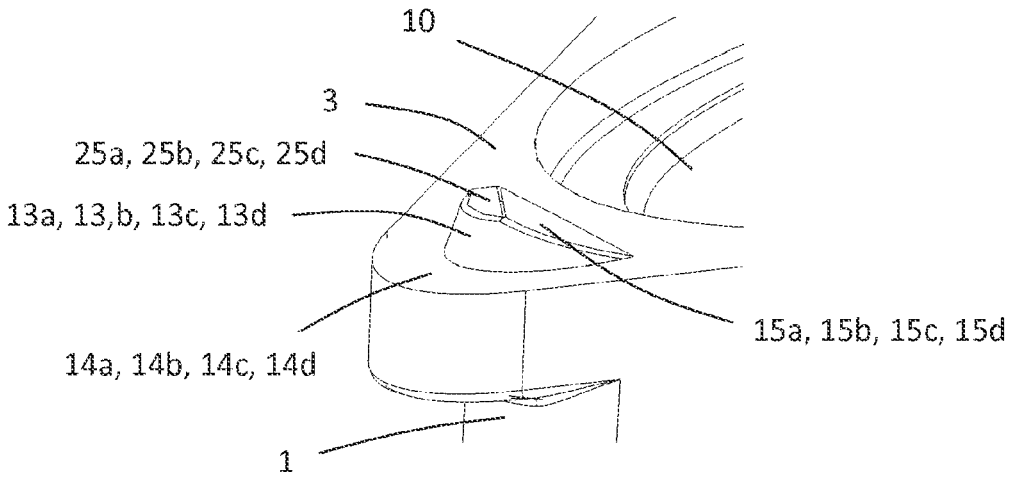
FIG. 5 is a schematic detailed view of the housing shown in FIG. 3.

FIG. 5 is a detailed view of a locking cam 13*a*, 13*b*, 13*c*, 13*d* formed on the housing 1. It can be seen in the process that the locking cam 13*a*, 13*b*, 13*c*, 13*d* is wedge-shaped in order to form a sliding surface 15*a*, 15*b*, 15*c*, 15*d* having an incline. The sliding surface 15*a*, 15*b*, 15*c*, 15*d* extends at a continuous incline from the lateral surface 3 towards a plateau 25*a*, 25*c*, 25*c*, 25*d* that is elevated relative to the support surface 7 defines the height of the locking cam 13*a*, 13*b*, 13*c*, 13*d*.

Figure 6:
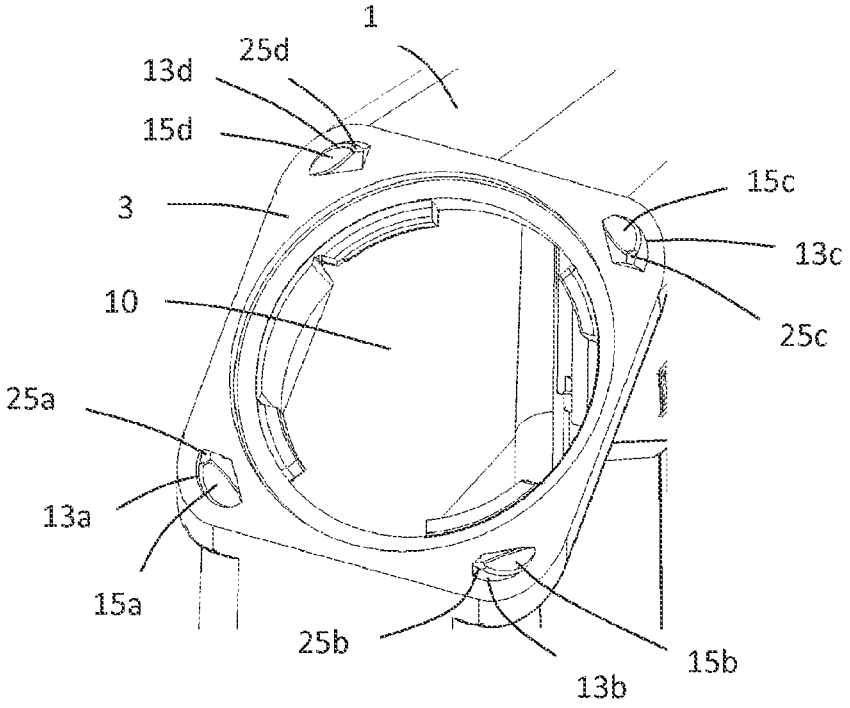
FIG. 6 is a further schematic view of the housing shown in FIG. 1.
Figure 7:
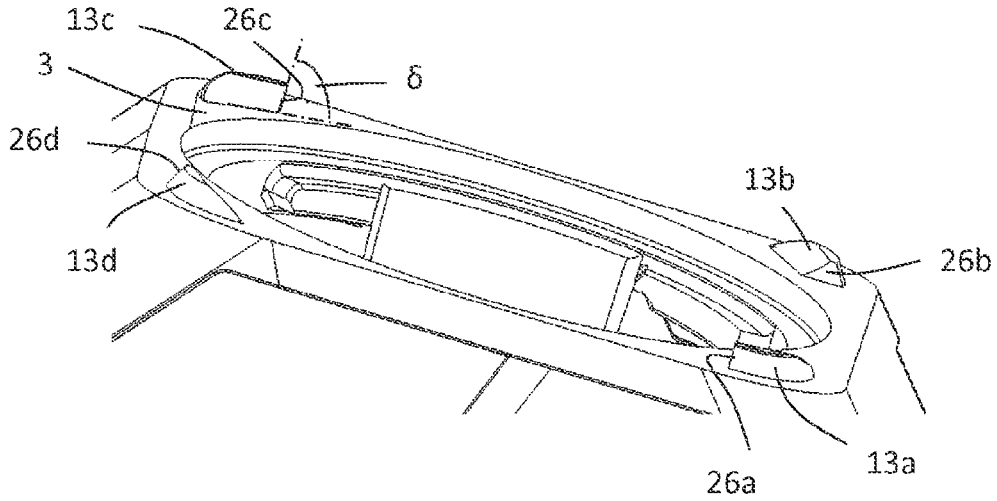
FIG. 7 is a further detailed schematic view of the housing shown in FIG. 1.

FIG. 6 shows a special configuration of the locking cams 13*a*, 13*b*, 13*c*, 13*d*, where the sliding surface 15*a*, 15*b*, 15*c*, 15*d* is also wedge-shaped in order to form the incline but, as can be seen in a plan view from above onto the sliding surface 15*a*, 15*b*, 15*c*, 15*d*, the sliding surface 15*a*, 15*b*, 15*c*, 15*d* is elliptical. The plateau 25*a*, 25*b*, 25*c*, 25*d* has a reduced surface in comparison with the embodiment shown in FIG. 4, the connection between the plateau 25*a*, 25*b*, 25*c*, 25*d* and the sliding surface 15*a*, 15*b*, 15*c*, 15*d* being relatively pointed as a result of the reduced surface of the plateau 25*a*, 25*b*, 25*c*, 25*d* and the elliptical configuration of the sliding surface 15*a*, 15*b*, 15*c*, 15*d*, as a result of which the sliding surface 15*a*, 15*b*, 15*c*, 15*d* has a notching effect. During a rotary movement of the cable gland 2 relative to the housing 1 for attaching the cable gland 2 to the housing 1, the locking cams 13*a*, 13*b*, 13*c*, 13*d* can therefore cut into the support surface 7 of the cable gland 2 with their sliding surface 15*a*, 15*b*, 15*c*, 15*d*.

FIG. 7 again shows another view of the locking cams 13*a*, 13*b*, 13*c*, 13*d* shown in FIGS. 3 and 5. The locking cams 13*a*, 13*b*, 13*c*, 13*d* shown here, but also the locking cams 13*a*, 13*b*, 13*c*, 13*d* shown in FIG. 6, each have steeply sloping lateral surfaces 26*a*, 26*b*, 26*c*, 26*d* adjacent to the plateau 25*a*, 25*b*, 25*c*, 25*d*, by which lateral surfaces the locking cams 13*a*, 13*b*, 13*c*, 13*d* can interlock with the corresponding recess 23*a*, 23*b*, 23*c*, 23*d*. This lateral surface 26*a*, 26*b*, 26*c*, 26*d* of a locking cam 13*a*, 13*b*, 13*c*, 13*d* forms an opening angle δ of between 90° and 130° with the lateral surface 3 of the housing 1. As a result of this incline of the lateral surface 26*a*, 26*b*, 26*c*, 26*d* of the locking cam 13*a*, 13*b*, 13*c*, 13*d*, the wear on the recess 23*a*, 23*b*, 23*c*, 23*d* in the cable gland 2 can be reduced and the retention force of the locking cams 13*a*, 13*b*, 13*c*, 13*d* can be increased.

Embodiments of the connector are shown in FIG. 8-11 where an anti-rotation element 27 is provided, which in an assembled state of the cable gland 2 on the housing 1 prevents a twisting of the cable gland 2 relative to the housing 1. Furthermore, the anti-rotation element 27 can also act as a centring, as a result of which in the assembled state a particularly tight fit of the cable gland 2 on the housing 1 is achieved and thus a flapping of the cable gland 2 on the housing 1 can be prevented. The anti-rotation element 27 is provided in addition to the locking cams 13*a*, 13*b*, 13*c*, 13*d* in the embodiments shown here. It is, however, also possible for the anti-rotation element 27 to be formed as an alternative to the locking cams 13*a*, 13*b*, 13*c*, 13*d* and thus when an anti-rotation element 27 is provided, locking cams 13*a*, 13*b*, 13*c*, 13*d* no longer have to be formed as well.

The anti-rotation element 27 is attached to a top side 28 of the housing 1, the anti-rotation element 27 being arranged off centre relative to the longitudinal axis 29 of the housing 1.

Figure 8:
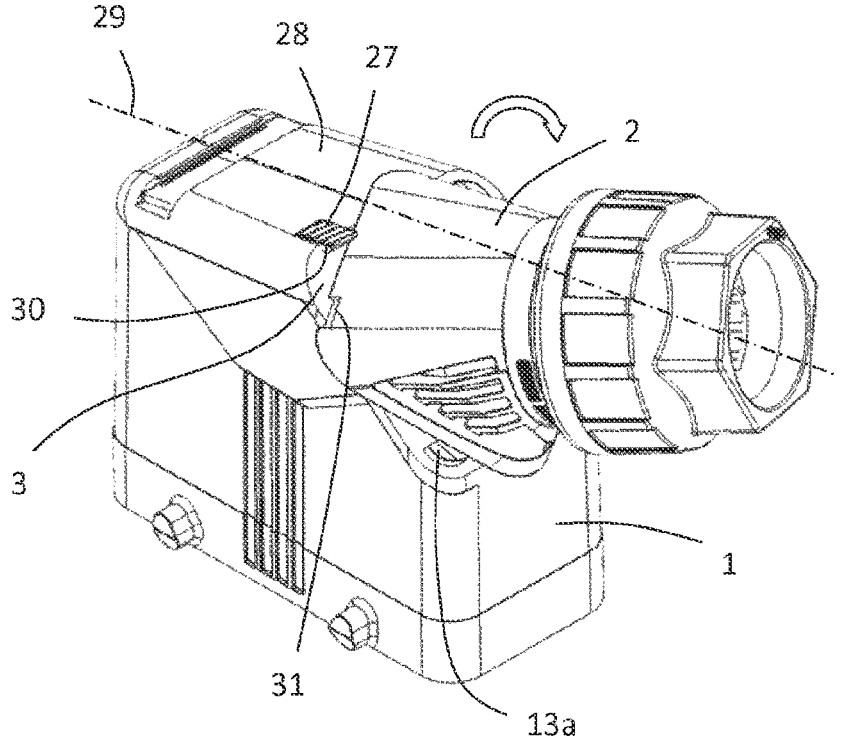
FIG. 8 is a schematic view of a connector with an anti-rotation element according to an embodiment of the invention.
Figure 9:
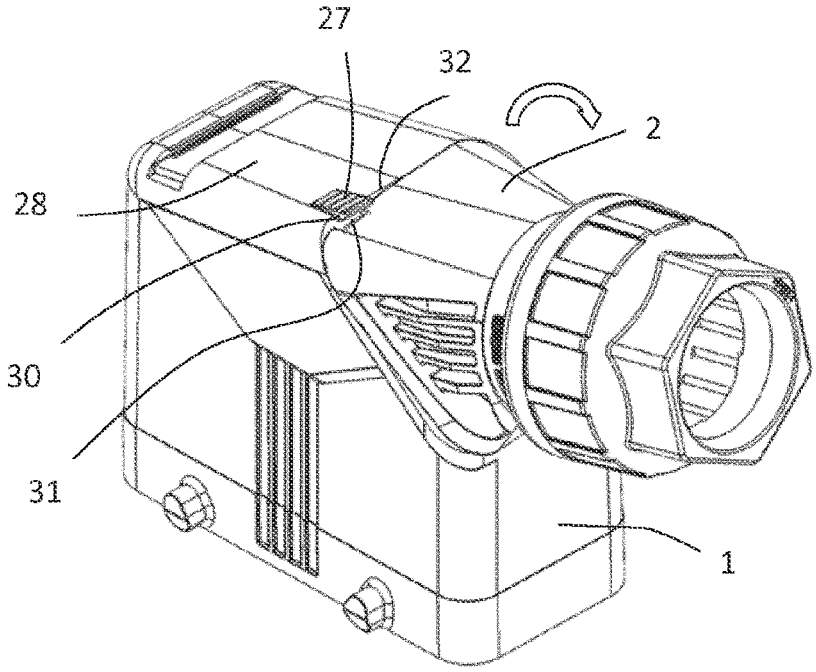
FIG. 9 is a further schematic view of the connector according to the embodiment shown in FIG. 8.
Figure 10:
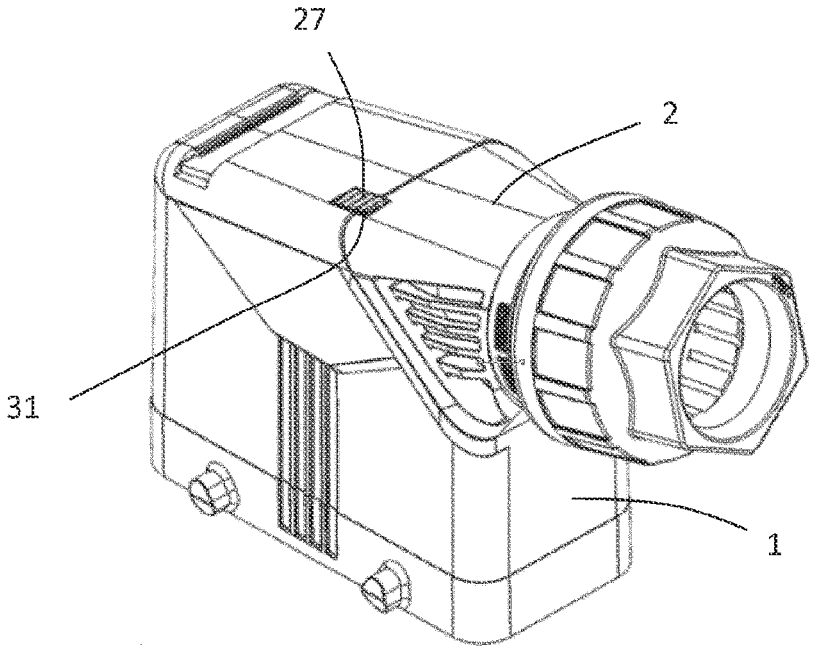
FIG. 10 is a further schematic view of the connector according to the embodiment shown in FIGS. 8 and 9.

In the case of the embodiment shown in FIG. 8-10, the anti-rotation element 27 is pivotally attached to the housing 1. The anti-rotation element 27 is attached to the housing 1 such that one end of it projects beyond the lateral surface 3 of the housing 1 to which the cable gland 2 can be attached. On this projecting end, the anti-rotation element 27 has a latch 30, which in the assembled state of the cable gland 2 on the housing 1 can catch or snap into a recess 31 formed in the cable gland 2.

FIG. 8-10 show the respective steps in the assembly of the cable gland 2 on the housing 1 and the corresponding movement of the anti-rotation element 27 in the process.

In FIG. 8, the cable gland 2 has been positioned on the lateral surface 3 of the housing 1, but not yet twisted into the final position. In FIG. 9, a twisting movement of the cable gland 2 relative to the housing 1 towards the shown arrow is taking place, an edge region 32 of the cable gland 2 touching the anti-rotation element 27 and pushing it upwards as a result such that the cable gland 2 can be twisted further into its final position, as shown in FIG. 10. In the final position, the anti-rotation element 27 interlocks with the recess 31 in the cable gland 2 as a result of a downwards movement, in that the edge region 32 now no longer pushes the anti-rotation element 27 upwards. The anti-rotation element 27 is released from the latched position by means of a tool.

Figure 11:
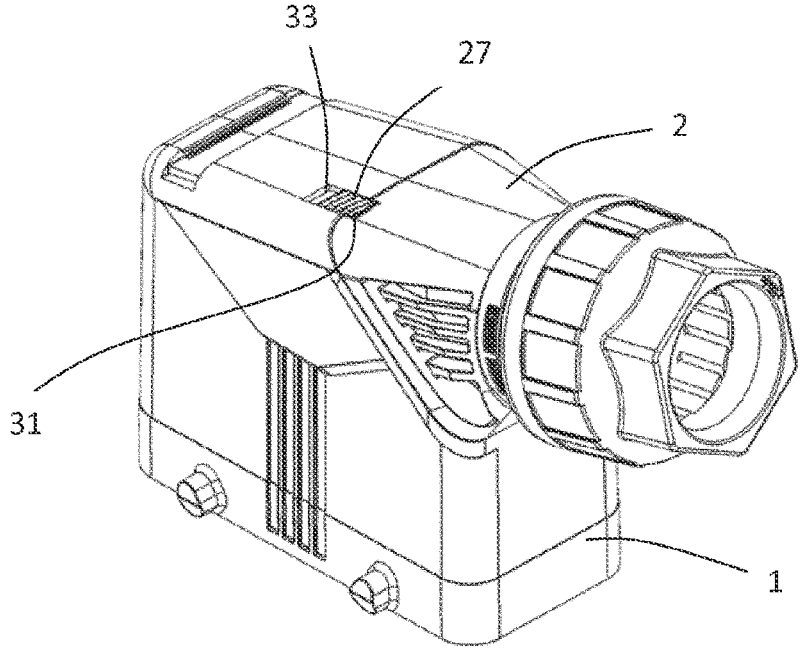
FIG. 11 is a schematic view of a connector with an anti-rotation element according to an embodiment of the invention.

In the embodiment shown in FIG. 11, the anti-rotation element 27 is not mounted pivotally on the housing 1 but rather is mounted displaceably in a recess 33 in the top side 28 of the housing 1. In the process, in the non-assembled state of the cable gland 2 on the housing 1, the anti-rotation element 27 does not project beyond the lateral surface 3 either, but is entirely accommodated in the holder 22. Only in the assembled state of the cable gland 2 on the housing 1, when the cable gland 2 is in its final position, as shown in FIG. 11, is the anti-rotation element 27 pushed inside the recess 33 towards the cable gland 2 until it engages in the recess 31, formed in the cable gland 2, and locks therein. To release the anti-rotation element 27, it has to be pushed back towards the housing 1 using a tool.

Figure 12:
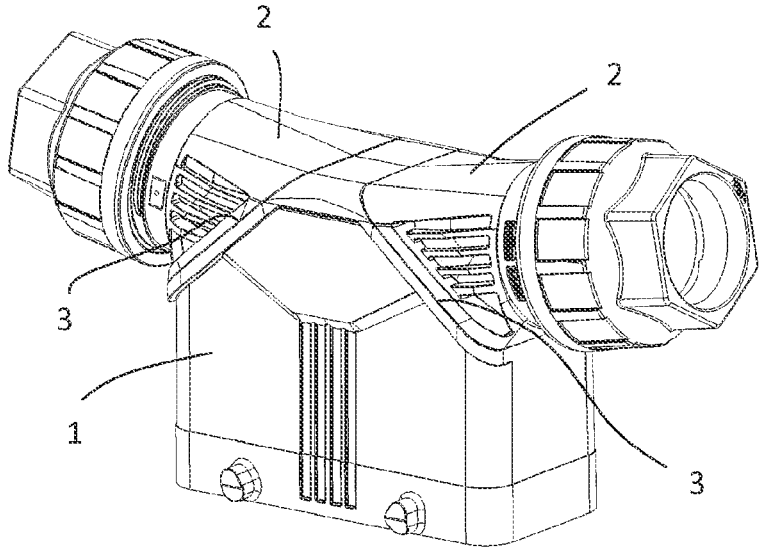
FIG. 12 is a schematic view of a connector with a housing and two cable glands arranged thereon according to an embodiment of the invention.

In FIG. 12, a further possible embodiment of a connector is shown, where two cable glands 2 are formed on a housing 1, the housing 1 having two lateral surfaces 3 formed symmetrically to one another which each have an opening 10 for passing a respective cable through and each have a holder for attaching the cable gland 2 to the housing 1. Here too, the cable glands 2 can be attached in different positions on the lateral surfaces 3 of the housing 1, such that various cable outlet directions, which can also differ from one another, can be formed.

Figure 13:
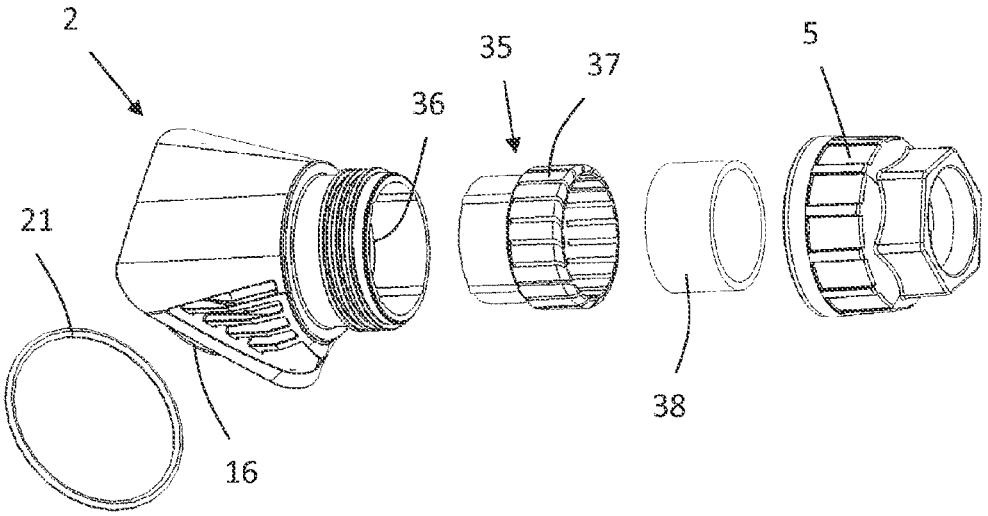
FIG. 13 is a schematic exploded view of both a metal cable gland and the structural elements arranged thereon according to an embodiment of the invention.

FIG. 13 is an exploded view of a cable gland 2 made of metal, for example aluminium or zinc, and the elements to be arranged on the cable gland 2. An annular clamping cage 35 is arranged in an inner space 36 in the metal cable gland 2 and comprises a plurality of ridges 36 arranged in a circular manner. The clamping cage 35 is arranged in the inner space 36 in the cable gland 2 such that the outer circumferential surface of the clamping cage 35 rests tightly on the wall of the cable gland 2 delimiting the inner space 36. The clamping cage 35, which can be formed of a plastics material, can either be inserted into the inner space 36 as a separate component or integrally moulded directly into the inner space 36 or onto the wall delimiting the inner space. An annular sealing element 38 made of plastics material is in turn arranged in the clamping cage 35 such that the ridges 37 of the clamping cage 35 can press onto the outer circumferential surface of the sealing element 38 so that, when a union nut 5 is screwed onto the cable gland 2, an inserted cable can be clamped by means of the union nut 5, the ridges 37 of the clamping cage 35 and the sealing element 38, which rests tightly on the cable. Furthermore, FIG. 13 shows an annular sealing element 21 in the form of an O-ring which can be arranged on the outer circumferential surface of the annular surface 16 of the cable gland 2.

Figure 14:
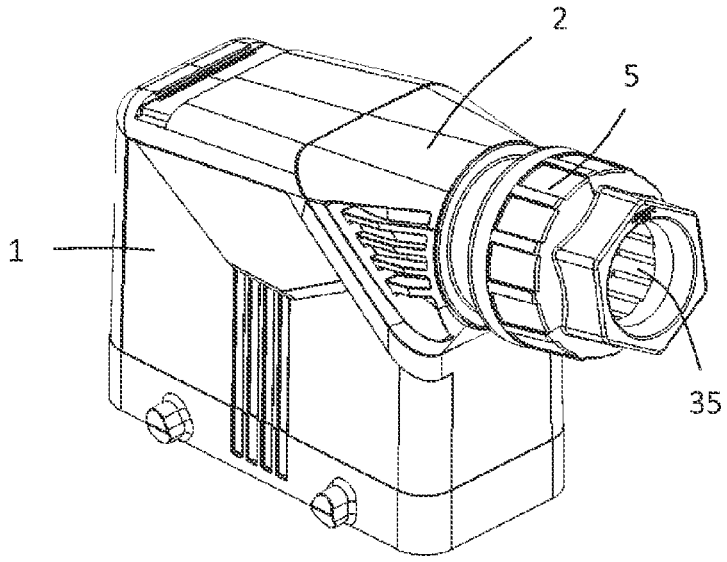
FIG. 14 is a schematic view of a connector having a housing and a cable gland made of metal according to an embodiment of the invention.

FIG. 14 shows a connector in an assembled state, in which the cable gland 2 is attached to the housing 1 and the union nut 5 is attached to the cable gland 2. The housing 1, the cable gland 2 and also the union nut 5 are formed of metal in this case.

Figure 15:
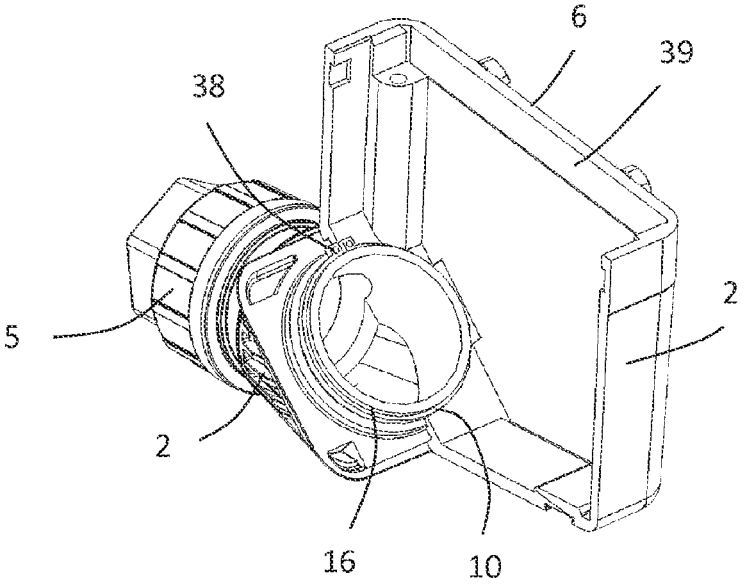
FIG. 15 is a schematic view of a connector having a housing shown in section in part, and a cable gland being attached to the housing by a snap ring, according to an embodiment of the invention.

FIG. 15 shows an embodiment in which the cable gland 2 is attached to the housing 1 by means of a snap ring 38. The snap ring 38 surrounds the annular surface 16 of the cable gland 2 and rests tightly on an internal wall delimiting the opening 10 in the housing 1. For clearer illustration, the housing 1 is shown here in a sectional view. During assembly, the cable gland 2 is first arranged in the opening 10 in the housing 1, and the snap ring 38 is then rigidly mounted on the annular surface 16 of the cable gland 2 by means of the base 6 of the housing 1, which base has an opening 39. By means of the opening 39, the contact element or the plurality of contact elements can be inserted into the housing 1. In this embodiment, the cable gland 2 is rigidly mounted on the housing 1 by means of the snap ring 38, it being possible for different cables of different cross sections to be clampingly guided through the cable gland 2 by means of a change of the clamping cage 38 and the union nut 5. The cable gland 2 can be axially secured to the housing 1 by means of the snap ring 38. Alternatively to the snap ring 38, the cable gland 2 can also be attached to the housing 1 by means of a pin.

Figure 16:
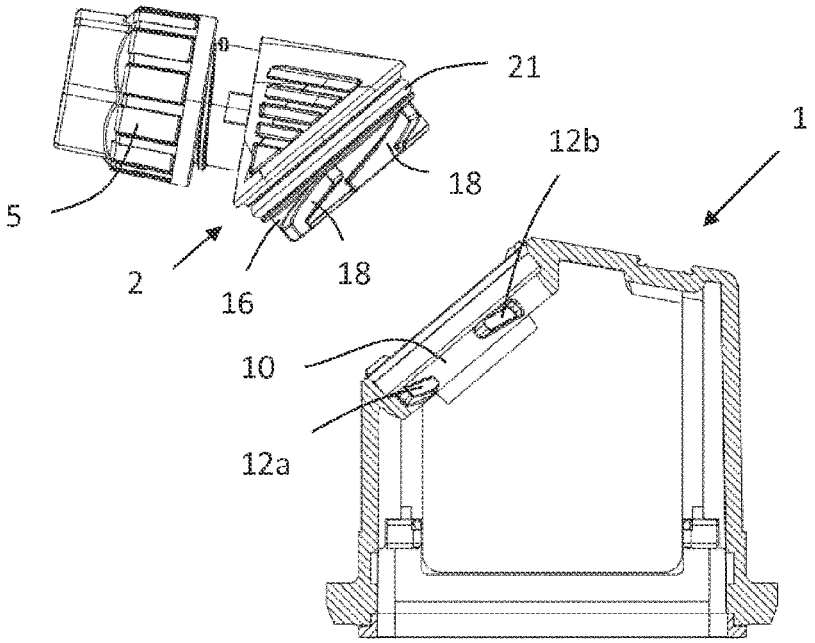
FIG. 16 is a schematic exploded view of a connector according to an embodiment of the invention.
Figure 17:
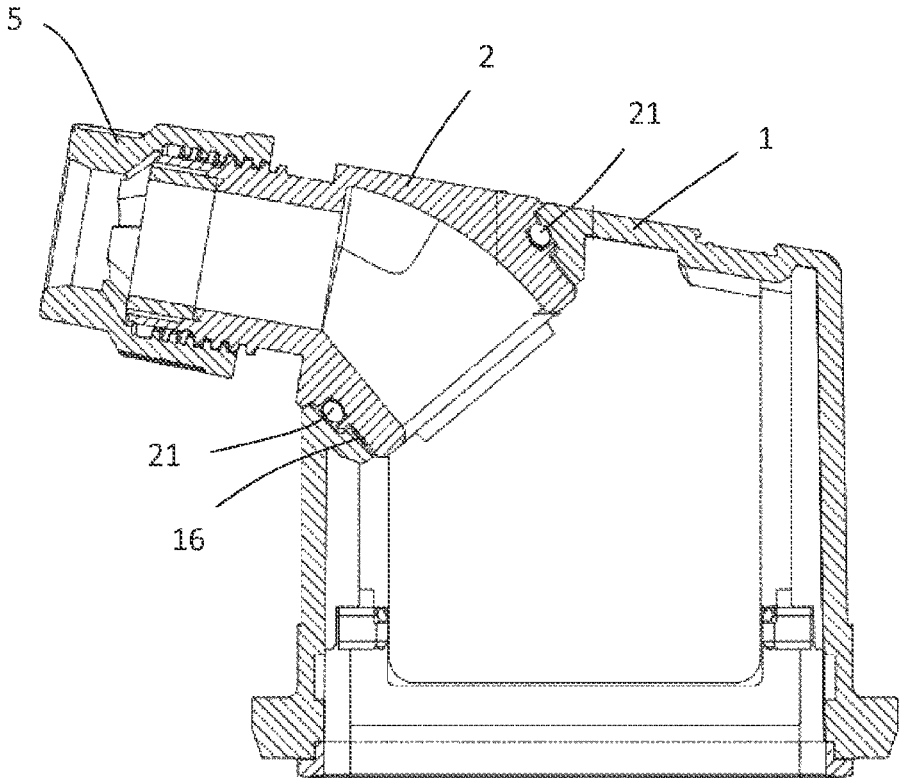
FIG. 17 is a schematic sectional view of the connector shown in FIG. 16 in an assembled state.

FIG. 16 is an exploded view of a connector, the housing 1 being shown in a sectional view. Both the cable gland 2 and the housing 1 are formed of a metal. The cable gland 2 comprises a plurality of undercuts 18 on the outer circumferential surface of the annular surface 16 thereof, two such undercuts 18 being visible in this case. Unlike the embodiment shown in FIG. 4, the undercuts 18 shown in FIG. 16 are provided with an incline of >0°. The web elements 12*a*, 12*b*, which engage in the undercuts 18 when the cable gland 2 is locked to the housing 1 in a bayonet-like manner, also have an incline of >0° corresponding to the pitch of the undercuts 18. Since both the undercuts 18 and the web elements 12*a*, 12*b* have an incline, the cable gland 2, when locked to the housing 1 in a bayonet-like manner, also causes an axial movement in addition to the rotational movement, and this axial movement moves the sealing element 21 into the desired sealing position between the housing 1 and the annular surface 16 of the cable gland 2. This allows for a reduction in the necessary forces to be applied when attaching the cable gland 2 to the housing 1. This is advantageous in particular when a sealing element 21 shown in FIG. 16 is arranged on the annular surface 16 of the cable gland 2, which, as shown in FIG. 17, brings about a radial sealing action against the opening 10 in the housing 1, and no axial sealing action against an edge of the cable gland 2, as occurs in the sealing element 21 shown in FIG. 4, is brought about.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

LIST OF REFERENCE SIGNS

| | |
|---|---|
| Housing | 1 |
| Cable gland | 2 |
| Lateral surface | 3 |
| Outer thread | 4 |
| Clamping nut | 5 |
| Base | 6 |
| Support surface | 7 |
| Longitudinal direction | 8 |
| Cross-sectional area | 9 |
| Opening | 10 |
| Holder | 11 |
| Web element | 12a, 12b, 12c, 12d |
| Locking cam | 13a, 13b, 13c, 13d |
| Corner region | 14a, 14b, 14c, 14d |
| Sliding surface | 15a, 15b, 15c, 15d |
| Annular surface | 16 |
| Opening | 17 |
| Undercut | 18 |
| Free end | 19 |
| Flattened region | 20a, 20b |
| Sealing element | 21 |
| Retainer | 22 |
| Recess | 23a, 23b, 23c, 23d |
| Fins | 24 |
| Plateau | 25a, 25b, 25c, 25d |

-continued

| LIST OF REFERENCE SIGNS | |
|---|---|
| Lateral surface | 26a, 26b, 26c, 26d |
| Anti-rotation element | 27 |
| Top side | 28 |
| Longitudinal axis | 29 |
| Latch | 30 |
| Recess | 31 |
| Edge region | 32 |
| Recess | 33 |
| Outer circumferential surface | 34 |
| Clamping cage | 35 |
| Inner space | 36 |
| Ridges | 37 |
| Snap ring | 38 |
| Opening | 39 |
| Angle | α |
| Angle | β |
| Angle of projection | γ |
| Opening angle | δ |
| Diameter | D |
| Width | B |

The invention claimed is:

1. A connector, comprising:

a housing, in which at least one contact is arranged; and at least one cable gland;

wherein the cable gland is configured to be attached to the housing and is configured to have a cable passed through, the cable capable of being contacted to at least one contact element in the housing, wherein an opening for passing the cable through and a holder for attaching the cable gland to the housing are formed on at least one lateral surface of the housing, wherein the cable gland can be attached to the holder in a first position with a first cable outlet direction and in a second position with a second cable outlet direction, wherein the at least one lateral surface of the housing is inclined at an angle (α) of between 30° and 50° relative to a base of the housing, wherein the cable gland has a support surface configured to support the cable gland on the lateral surface of the housing in an attached state, wherein the support surface of the cable gland is inclined relative to a longitudinal direction of the cable gland at an angle (β) of between 40° and 60°, wherein the cable gland is attachable to the housing by a bayonet-type locking mechanism, wherein the holder of the housing has at least two locking cams arranged on the lateral surface of the housing, wherein the bayonet-type locking mechanism comprises that at lease two locking cams arranged on the lateral surface of the housing, and wherein the locking cams have a sliding surface with an incline, the sliding surface being curved.

2. The connector according to claim 1, wherein the cable gland has an annular surface that, in the attached state of the cable gland to the housing, engages in the opening in the housing, wherein the holder of the housing having at least two web elements arranged in the opening in the housing and at least two undercuts being formed on an outer circumferential surface of the annular surface of the cable gland, into which undercuts the web elements can be inserted and locked, in order to form the bayonet-type locking mechanism.

3. The connector according to claim 2, wherein four web elements are arranged in the opening in the housing, two respective web elements being arranged diagonally to one another in each case, a first pair of diagonally arranged web elements being longer than a second pair of diagonally arranged web elements.

4. The connector according to claim 1, wherein the locking cams have a different height.

5. The connector according to claim 1, wherein the sliding surface is formed such that during transfer into the attached state, the sliding surface has a notching effect.

6. The connector according to claim 2, wherein the annular surface has at least one flattened region for accommodating the cable.

7. The connector according to claim 1, wherein the housing and/or the cable gland have a sealing element.

8. The connector according to claim 1, wherein the diameter of the opening in the housing is roughly equivalent to the width of the housing.

9. The connector according to claim 1, wherein the housing is made from a reinforced plastics material.

10. The connector according to claim 1, wherein the cable gland is made from a plastics material that is more malleable than the housing.

11. The connector according to claim 1, wherein at least one of the housing or the cable gland is formed of a metal.

12. The connector according to claim 1, wherein the cable gland has at least two locking cams arranged on the support surface of the cable gland, the at least two locking cams configured to engage in at least one of recesses arranged in the lateral surface of the housing and recesses arranged in the support surface of the cable gland, and wherein the bayonet-type locking mechanism comprises the at least two locking cams which are arranged on the support surface of the cable gland.

* * * * *